United States Patent [19]

Bianchi et al.

[11] 4,391,249

[45] Jul. 5, 1983

[54] METHOD OF OPERATING A COMBUSTIBLE MIXTURE GENERATOR OF AN INTERNAL COMBUSTION ENGINE AND APPARATUS FOR CARRYING OUT THE METHOD

[75] Inventors: Valerio Bianchi, Neuss-Hoisten; Franz-Josef Ehrentraut, Mönchengladbach; Peter Wöbky, Dormagen, all of Fed. Rep. of Germany

[73] Assignee: Bosch und Pierburg System oHG, Neuss, Fed. Rep. of Germany

[21] Appl. No.: 163,992

[22] Filed: Jun. 30, 1980

[30] Foreign Application Priority Data

Jul. 11, 1979 [DE] Fed. Rep. of Germany ..... 2927881

[51] Int. Cl.[3] ..... F02M 7/06

[52] U.S. Cl. ..... 123/438; 123/442; 261/39 R; 261/52

[58] Field of Search ..... 123/438, 442, 399, 439, 123/492, 440; 261/52, 39 R

[56] References Cited

U.S. PATENT DOCUMENTS

| | | | |
|---|---|---|---|
| 2,040,254 | 5/1936 | Fitz Gerald | 261/152 |
| 3,673,989 | 7/1972 | Aono et al. | 261/39 R |
| 4,011,844 | 3/1977 | Hirosawa et al. | 261/39 R |
| 4,046,118 | 9/1977 | Aono | 123/438 |
| 4,075,982 | 2/1978 | Asano et al. | 123/440 |
| 4,121,545 | 10/1978 | Mizote | 123/494 |
| 4,129,105 | 12/1978 | Ito et al. | 123/440 |
| 4,245,605 | 1/1981 | Rice et al. | 123/492 |

FOREIGN PATENT DOCUMENTS

| | | | |
|---|---|---|---|
| 2312661 | 12/1976 | France | 261/39 R |
| 351405 | 6/1931 | United Kingdom . | |

*Primary Examiner*—Charles J. Myhre
*Assistant Examiner*—Andrew M. Dolinar
*Attorney, Agent, or Firm*—Toren, McGeady and Stanger

[57] ABSTRACT

In order to produce a transition mixture enrichment during acceleration of an internal combustion engine, a carburettor or other mixture generator 1 of the engine with a mixing chamber 2, a main throttle 4 and a choke valve 5, has the choke valve 5 operated by a quick-acting electric drive 6, for example a two-coil rotary setter, which is controlled by a microprocessor 8. The microprocessor is fed with signals which sense the opening of the main throttle 4 and preferably also other engine operating parameters such as temperature and speed. When the main throttle 4 is opened to accelerate the engine, the microprocessor 8 causes the electric drive 6 to close the choke valve 5 abruptly and temporarily. The extent of closure of the choke valve 5 is dependent upon the extent of the throttle opening and on the other operating parameters to give the required mixture enrichment. This arrangement avoids the necessity to provide an accelerator pump.

17 Claims, 7 Drawing Figures

Figure 1:
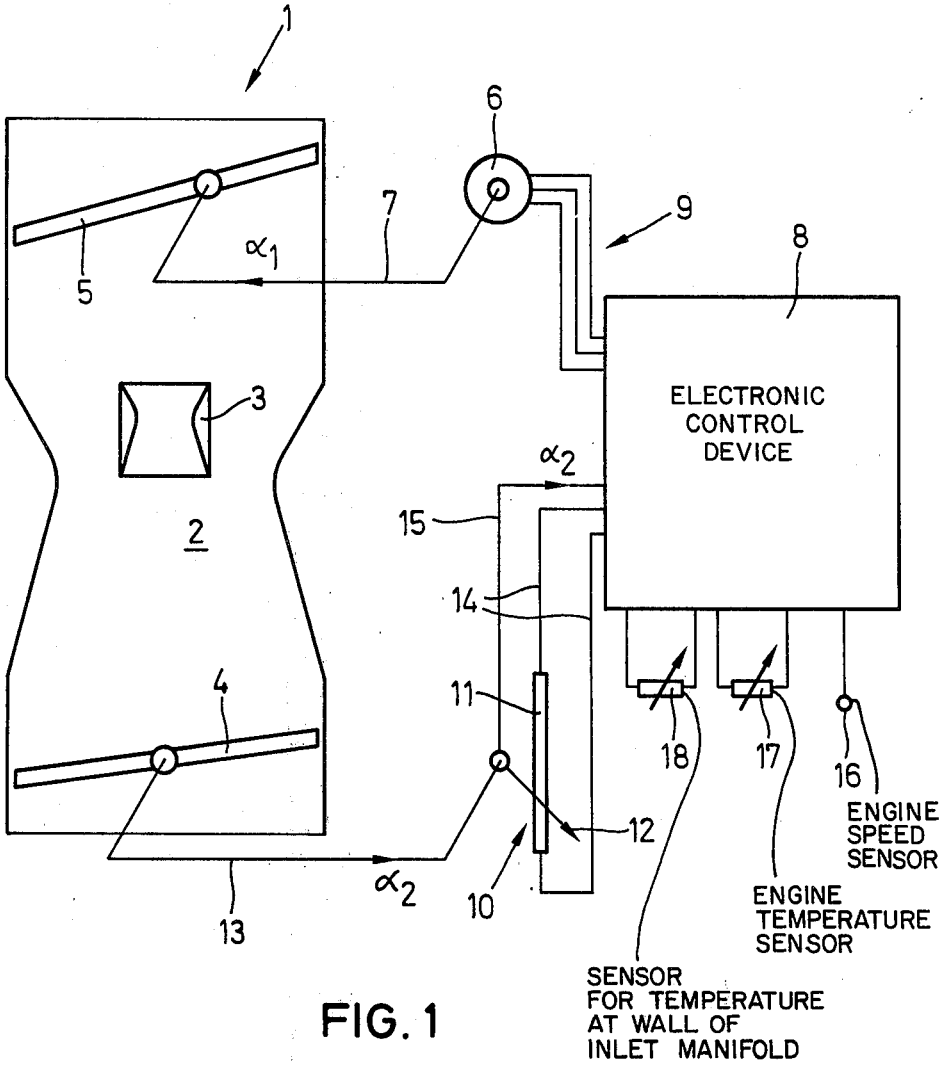
Figure 1A:
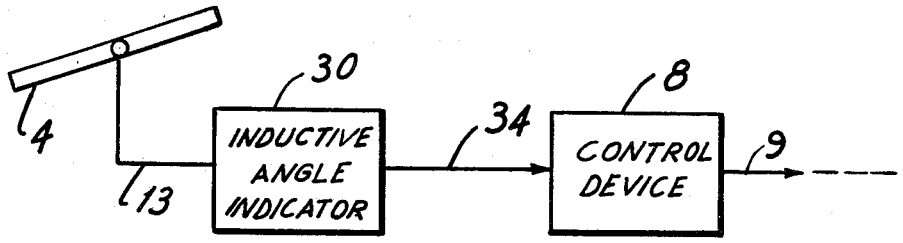
Figure 1B:
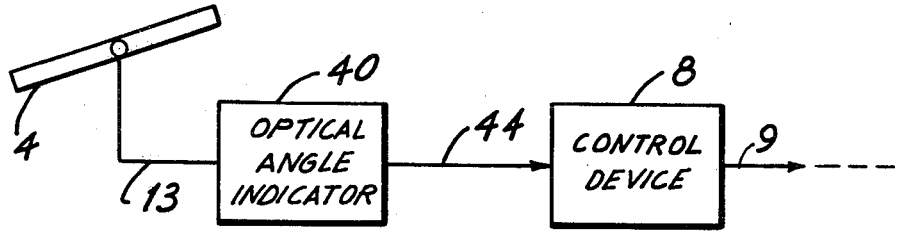
Figure 1C:
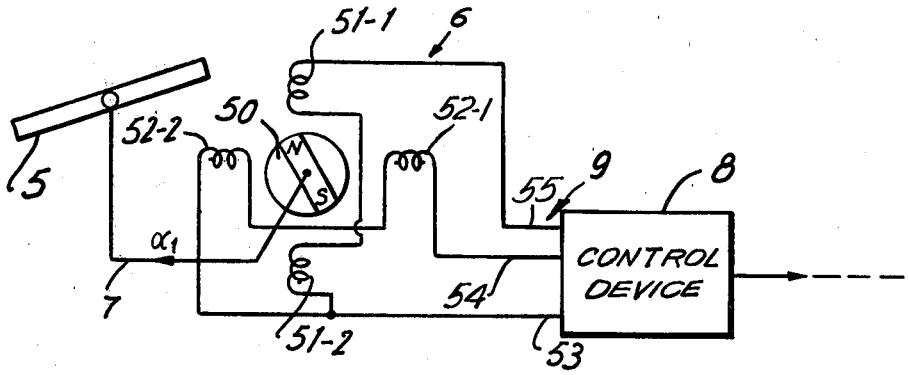

METHOD OF OPERATING A COMBUSTIBLE MIXTURE GENERATOR OF AN INTERNAL COMBUSTION ENGINE AND APPARATUS FOR CARRYING OUT THE METHOD

This invention relates to a method of and apparatus for operating a combustible mixture generator of an internal combustion engine to produce a transition mixture enrichment during acceleration of the engine, the mixture generator comprising a mixing chamber, a main throttle downstream of the chamber and a choke valve upstream of the chamber, an electric drive operating the choke valve, and a control device which senses at least one operating parameter of the engine and controls the electric drive to move the choke valve into positions for cold starting, running-up and hot-running mixture enrichment.

The choke valve which is in the form of a flap of an automatic choke of a fixed venturi carburettor is usually acted upon by a bi-metal spring heated in dependence upon the engine temperature and by a diaphragm acted upon by the reduced pressure in the engine inlet to set its angular position in order to achieve satisfactory cold-starting, running-up and hot-running enrichment of the mixture. According to German Offenlegungsschriften Nos. 25 11 288, 25 16 477, 25 25 594 and 25 25 595, in order to carry out these enrichment operations, the bi-metal spring and the diaphragm controlled by the reduced pressure are dispensed with and instead the choke valve flap is coupled to a stepping motor through a spiral spring which is not temperature sensitive. The motor is controlled depending on operating parameters, particularly the engine temperature, to rotate the choke-valve flap through the spring connection. In all these existing arrangements, moreover, the angular adjustment of the main throttle which is another flap is controlled depending on temperature, usually through a stepped cone drive. This has the important disadvantage that the accelerator pedal has to be pressed fully down and be released before starting the engine. Further, in all existing arrangements of this kind, a separate accelerator pump is provided and is coupled to the main throttle flap. This ensures that additional fuel is injected into the mixing chamber on an accelerating actuation of the main throttle flap. Thus the existing arrangements are relatively complicated in construction, comparatively expensive, difficult to operate and liable to breakdown, for example because of the risk of the formation of gas bubbles in the accelerator pump.

It is an object of the present invention to provide a method and an apparatus as initially described which avoid the disadvantages outlined, so that all the necessary mixture enrichment operations, particularly the transition enrichment, can be carried out in a very reliable and simple manner with a single final control element.

To this end, according to one aspect of this invention, a method as initially described is characterised by holding the choke valve open in steady operation of the engine and temporarily abruptly at least partly closing the choke valve by means of the electric drive upon operation of the main throttle to accelerate the engine. Thus, the electric drive not only effects the cold-starting, running-up and hot-running enrichment of the mixture as is known, but now in addition also effects the transition enrichment by the abrupt temporary closing of the choke valve member upon acceleration taking place. As a result of the rapid movement of the choke valve and the rapid pressure reduction which occurs as a result in the mixing chamber down almost to the engine inlet pressure, the effect is achieved that the main fuel supply system to the chamber comes into action very quickly and delivers larger amounts of fuel. As a result of this, in synchronism with each acceleration, the additional amount of fuel needed for the compensation of flat spots is supplied practically without delay. The method in accordance with the invention can be used with fixed venturi carburettors and with constant-pressure carburettors, particularly when an appropriate choke valve is connected into the air flow path of the latter.

In the method in accordance with the invention, the magnitude and duration of the closing of the choke valve during acceleration is preferably made dependent on measured operating parameters of the engine, for example in such a manner that the magnitude and the duration of the closing are made smaller, the greater the degree of opening of the main throttle that exists before the acceleration takes place, the lower the rate and degree of acceleration, that is throttle opening, the higher the engine temperature and the higher the engine speed. Furthermore, the closing of the choke valve is preferably effected when the rate of opening of the main throttle exceeds a predetermined threshold value. Below this threshold value, that is to say with relatively slow opening adjustments of the main throttle, there is not sufficient acceleration to make any closing of the choke valve necessary. Above the threshold value, an optimum control behaviour with regard to exhaust gas composition, running behaviour and fuel consumption of the engine is achieved by controlling the magnitude and duration of the closing of the choke valve in dependence on the operating parameters. In order to avoid excessive mixture enrichment on repeated actuation of the main throttle, it is further desirable to take into consideration the time between two accelerating operations in determining a new magnitude and duration of the closing of the choke valve or the new increased amount of fuel. After expiration of a period of time, a gradual opening operaton may appropriately be carried out, preferably linearly in time.

According to another aspect of the invention, apparatus for carrying out the method in accordance with the invention comprises a combustible mixture generator for an internal combustion engine, the mixture generator comprising a mixing chamber, a main throttle downstream of the chamber and a choke valve upstream of the chamber, an electric drive operating the choke valve, and a control device which senses at least one operating parameter of the engine and controls the electric drive to move the choke valve into position for cold starting, running-up and hot-running mixture enrichment, wherein the electric drive is in the form of a quick-acting drive and is torsionally rigidly connected to the choke valve, and the control device is connected, at its input side, to a sensor which senses the opening of the main throttle and produces a signal which operates the drive to close the choke valve abruptly and temporarily when opening of the main throttle is sensed.

When the main throttle is in the form of a flap, the sensor is in the form of an angular-position sensor. This can be inductive or optically coded angle indicator or, in a simple example, a potentiometer, a tap of which is in mechanical driving connection with the main throttle flap. The control device preferably includes a circuit which is connected to the condition sensor and differentiates with respect to time the angular position of the main throttle to provide a signal indicating the rate of opening of the throttle.

As a result of the torsionally rigid driving connection of the electric drive to the choke valve and the sensor coupled to the main throttle, the apparatus in accordance with the invention makes possible an abrupt closing of the choke valve when acceleration takes place so that a mechanical accelerator pump is no longer necessary. In addition, the transition mixture enrichment is initiated in a very reliable manner, without delay, because the main fuel supply system to the mixture generator is acted upon by almost the full suction pressure in the engine inlet owing to the abrupt closing of the choke valve as acceleration takes place. It is possible to detect the opening speed of the main throttle directly in order to etect the acceleration, but this presupposes separate sensors for detecting the opening and the speed of opening. Calculation of the speed of opening by differentiation with respect to time of the angular position of the main throttle is simpler. This differentiation can be effected by a microprocessor which then forms the control device.

The control device of the apparatus which is actuated in dependence on the angular position or the degree of opening of the main throttle and preferably also opening speed is preferably further connected to an engine speed sensor and at least one engine temperature sensor. A sensor which detects the temperature of the wall of an engine inlet manifold is preferably also provided in order to achieve a particularly favourable mixture enrichment relationship. With certain forms of construction, this last-mentioned sensor may be disposed in the vicinity of an inlet manifold cooling water passage so that only a single temperature sensor is necessary and this senses a temperature which is related to both the cooling water temperature and the manifold temperature.

For a simple, reliable and economical realisation of the control functions, a microprocessor which converts the various operating parameters fed to its input side into control signals for the electric drive at its output side in dependence upon engine operating performance data stored in the microprocessor is preferred as a control device. Such an electronic device makes it possible to make a very rapid, accurate and absolutely reliable calculation of control signals depending on input operating parameters and stored operating performance data with the minimum use of space and minimum cost.

A transition mixture enrichment which is brought about without delay when acceleration takes place is assured as the electric drive of the choke valve works very quickly when actuated and reaches its desired position abruptly. If the choke valve is constructed in the form of a pivotally mounted choke valve flap, it is extremely advantageous to construct the electric drive in the form of a two-coil rotary setter which operates in the manner of a two-phase synchronous notor with windings mutually offset by an angle of 90°, the coils of the setter being controllable independently of one another by direct currents, and a permanent-magnet rotor being moved by the magnetic field produced by the coils. The direction of the magnetic field of the two-coil rotary setter energised by direct current results from the ratio in magnitude of the direct currents supplied to the coils and the low-inertia permanent-magnet rotor can adjust itself without delay and very precisely to the particular direction of the magnetic field. In this case no measuring and restoring of the rotor angle setting is necessary, as would be the necessary, for example, if a direct-current motor or a rotary magnet were used.

Instead of detecting certain other operating parameters, it is also possible to provide an air-volume meter in the air flow path of the mixture generator and to connect the output of the meter to the input of the control device. This embodiment is logical if air-volume meters suitable for this purpose can be made at reasonable cost.

Figure 2:
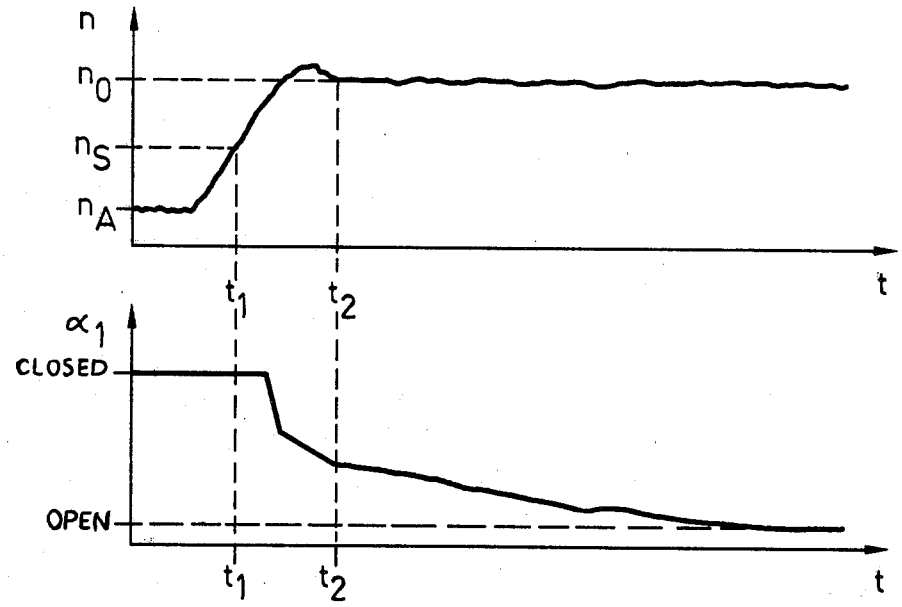
Figure 3:
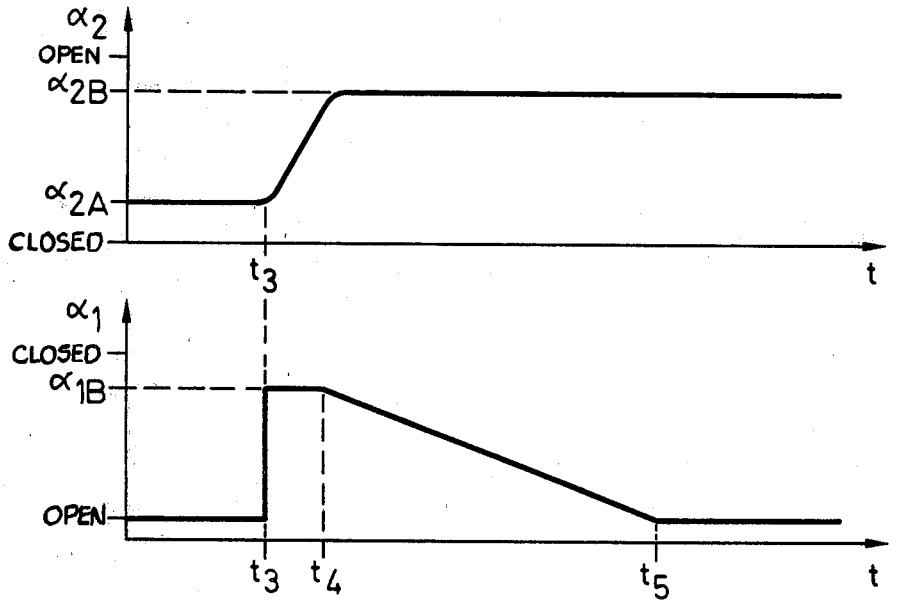

An example of a method and of apparatus in accordance with the invention will now be described with reference to the accompanying drawings, in which:

FIG. 1 is a diagrammatic general view of the apparatus;

FIGS. 1*a*, 1*b*, 1*c* and 1*d* are schematic illustrations of different control embodiments in accordance with the present invention;

FIG. 2 shows graphs of cold-running, running-up and hot-running mixture enrichment against time; and, FIG. 3 shows graphs of transition mixture enrichment against time during acceleration.

In FIG. 1, a combustible mixture generator 1 is illustrated in the form of a fixed venturi carburettor with a mixing chamber 2, in which there is a preliminary fuel atomiser 3. Downstream of the mixing chamber 2 is a main throttle 4 in the form of a pivotable main throttle flap, and upstream of the mixing chamber 2 is a choke valve 5 which, in this example, is constructed in the form of an eccentrically mounted, pivotable choke valve flap. The choke valve 5 is connected, through a torsionally rigid driving connection 7, to the output of an electric drive 6 in the form of a quick-acting two-coil rotary setter. At its input side, the rotary setter 6 is connected, through an electrical three-conductor connection 9, to the control output of an electronic control device 8 which, in the present example, is a microprocessor. Stored in the memory of the microprocessor are the operating performance graphs necessary for controlling the cold-starting, running-up, hot-running and transition mixture enrichment, by means of which control signals for the electric drive 6 are calculated in dependence on the operating parameters fed into the microprocessor.

A position sensor 10 which, in the present example, is in the form of a potentiometer 11, has an adjustable tap 12 which has a mechanical driving connection 13 to the main throttle 4. The sensor 10 detects the angular position or the instantaneous degree of opening of the main throttle 4. The potentiometer 11 is electrically fed, through supply lines 14, from the control device 8, and its tap 12 is adjusted in synchronism with the angular position $\alpha_2$ of the main throttle member 4. An electrical signal corresponding to the angular position $\alpha_2$ is taken off at the tap 12 and supplied via a tap line 15 to the control device 8. This contains a program section with which the angular position $\alpha_2$ of the main throttle member 4 is differentiated with respect to time so as to produce an adjusting speed signal $d\alpha_2/dt$ as an operating parameter. This speed signal is preferably supplied, in the control device 8, to a program section working as a threshold-value detector which only produces a signal indicating that there is an accelerating operation when the throttle is being opened at a speed above a predetermined minimum. Only in this case is a control operation of the electric motor drive 6 initiated which influences the degree of opening or the angular position $\alpha_1$ of the choke valve flap 5. In another embodiment an inductive angle indicator 30 can be used in place of the potentiometer 11, note FIG. 1*a*. The inductive angle indicator is connected to the main throttle 4 by the mechanical driving connection 13 and to the control device 8 by a line 34. In a further embodiment the potentiometer 11 is replaced by an optical angle indicator 40 which is connected to the main throttle valve 4 by the mechanical driving connection 13 and to the control device 8 by a line 44.

The control device 8 is also connected, at its input side, to an engine speed sensor 16, which may as a simple example be a detector which detects the ignition pulse from an ignition system of the engine. An engine-temperature sensor 17, which, for example, detects the temperature of the engine cooling water, is preferably constructed in the form of a resistor with a negative temperature coefficient and is connected to the input side of the control device 8. In the present example, a sensor 18 for sensing the temperature of the wall of the inlet manifold of the engine is further provided. This is likewise constructed in the form of a negative temperature coefficient resistor and is connected to the input of the control device 8. Both sensors may be replaced by a single temperature sensor if the temperature of the inlet manifold wall is sensed in the vicinity of the place where the cooling water is circulated.

In the upper part of FIG. 2, the speed n of the engine which occurs during starting is shown plotted against time. During the starting of the engine, a starter speed $n_A$ results and at the instant $t_1$ a speed threshold $n_S$ is reached. The time up to the instant $t_1$ can be called the starting time. After that, the speed n increases ultimately up to the idling speed $n_0$, and the time between $t_1$ and $t_2$ can be called the running-up time. Then follows the hot-running time within which the idling speed $n_0$ remains substantially constant. In the lower part of FIG. 2, the degree of opening or the angular position $\alpha_1$ of the choke valve 5 is plotted against time. During the starting time up to $t_1$ the choke valve 5 is kept closed. In the running-up time, opening of the choke valve 5 is at first delayed to obtain a somewhat richer mixture and ensure reliable running-up. After that, in the latter part of the running-up time (between $t_1$ and $t_2$) in the present example, the choke valve 5 is opened in two different operations, which are linear in time, at first rapidly and then more slowly up to a certain intermediate position which depends on the temperature of the cooling water. During the hot-running time following $t_2$, the position of the choke valve is dependent upon the rising temperature of the cooling water and on the consequently necessary decreasing mixture enrichment. Thus, the choke valve 5 is gradually opened completely depending on the temperature of the cooling water.

The cold-starting, running-up and hot-running mixture enrichment operations illustrated in FIG. 2 are known per se and are carried out independently of acceleration enrichment.

When, as shown in the upper part of FIG. 3, the main throttle 4 is opened sufficiently quickly from a first angular position $\alpha_{2A}$ to a second angular position $\alpha_{2B}$, that is to say when the speed of opening of the main throttle 4 exceeds a certain threshold value, as shown in the lower part of FIG. 3, the open choke valve 5 is closed again, without delay, at the instant $t_3$ when acceleration starts, into an angular position $\alpha_{1B}$ which is set to provide the required amount of transition enrichment. This new angular position, which is reached as abruptly as possible, is retained during a period between $t_3$ and $t_4$. Then follows a gradual opening of the choke valve 5, in the present example linearly in time, until the full degree of opening is again reached at the instant $t_5$. As already mentioned, the magnitude of the angle $\alpha_{1B}$ and the period of time between $t_3$ and $t_4$ are made dependent on various operating parameters fed into the control device 8, particularly on the angular position $\alpha_{2A}$ of the main throttle 4 before acceleration starts, on the speed of opening $d\alpha_{2A}/dt$ during the acceleration, on the engine temperature, optionally on the temperature of the wall of the inlet manifold, on the engine speed and optionally also on the time which has elapsed from the previous to the new accelerating throttle actuation. The opening operation of the choke valve 5, linearly in time, between the times $t_4$ and $t_5$ is only given by way of example and can also be carried out in other ways.

When an accelerating operaion is recognised by the control device 8 on exceeding of the predetermined threshold value of the opening speed of the main throttle 4, direct current control signals for the electric drive 6 are produced by the microprocessor in dependence on the operating parameters fed into the device and on performance data stored in the device. The drive 6, which is constructed in the form of a two-coil rotary setter, as already mentioned, has two windings which are offset at an angle of 90°. Controlling direct currents are impressed on the two windings in an independent manner through the three-conductor connection 9. Thus, depending on the ratio of the magnitudes of the direct currents, a magnetic field directed in a specific direction can be produced in the two-coil rotary setter. This field is followed by a bipolar permanent-magnet rotor, not illustrated, which is in rigid driving connection 7 with the choke valve 5. Such a two-coil rotary setter is a quick-acting final control element in comparison with a stepping motor, and through it a direct positioning of the choke valve is effected. The electric drive 6 has no effect on the main throttle and there is no stepped cone present as some existing devices. The final control element renders possible a very fine setting for every operating temperature and every region of the performance graph of the engine.

Thus, by means of the present invention, cold-starting, running-up, hot-running and transition mixture enrichment is carried out solely by actuation of the choke valve by a single final control element. Electronic control of the mixture composition of air and fuel is effected in static and in dynamic operation. The electric drive 6 takes over the functions of a bi-metal spring, of an engine inlet vacuum control and of an accelerator pump. This results in a considerably simpler and more economical construction and more accurate and easier operation. Consequently, the problems of pollutants in the exhaust gas, the running behaviour and the fuel consumption of the engine is considerably improved. The microprocessor makes possible a simple adaptation of the individual operations to the particular requirements, for example corrections in the idle running range or very great degress of opening of the main throttle in order to avoid a desired deviation in the mixture composition. Depending on the operating parameters fed into the microprocessor, these corrections can be carried out solely by influencing the electrical input to the microprocessor in which the required functions can be realised by the cyclic sequence of a plurality of sub-routines.

Figure 1D:
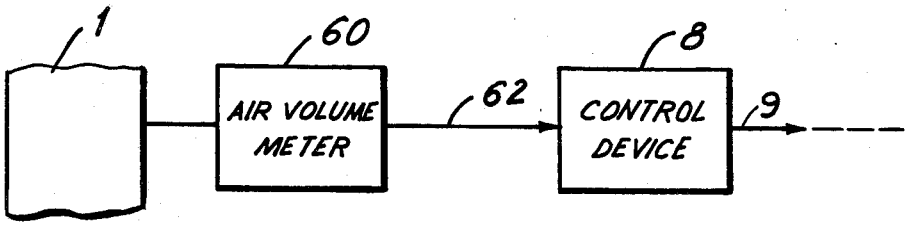

Instead of detecting certain other operating parameters, in FIG. 1*d*, an air volume meter 60 is provided in the air flow path of the mixture generator 1 and a line 62 connects the output of the meter 60 to the input of the control device 8.

We claim:

1. In a method of operating a combustible mixture generator of an internal combustion engine to produce a transition mixture enrichment during acceleration of said engine, said mixture generator including means defining a mixing chamber, a main throttle downstream of said chamber, a choke valve upstream of said chamber, an electric drive for operating said choke valve, means for sensing at least one operating parameter of said engine, and a control device which is controlled by said sensing means and controls said electric drive to move said choke valve into positions for cold starting, running-up and hot-running mixture enrichment, said method comprising the steps of holding said choke valve open in steady operation of said engine, sensing the instantaneous degree of opening of said main throttle valve with the sensing means, and when the speed of opening said main throttle exceeds a predetermined threshold value conveying respective signals from the sensing means to the control device and from the control device to the electric drive for temporarily abruptly at least partly closing said choke valve by a predetermined magnitude by means of said electric drive and measuring at least one of a plurality of operating parameters of said engine and making said predetermined magnitude and the duration of said closing of said choke valve dependent upon the measurements of said at least one parameter.

2. A method as claimed in claim 1, in which said operating parameters include the magnitude of the opening of the said main throttle before acceleration starts, the speed of opening of said throttle during acceleration, engine temperature and engine speed and further comprising using control signals from said sensed parameters, feeding said control signals to an electronic controller and causing said electronic controller to control said electric drive.

3. A method as claimed in claim 1, further comprising the step of gradually opening said choke valve after said temporary abrupt closing of said valve.

4. A method as claimed in claim 3, in which said gradual opening of said choke valve is carried out linearly in time.

5. In a method of operating a combustible mixture generator of an internal combustion engine to produce a transition mixture enrichment during acceleration of said engine, said mixture generator including means defining a mixing chamber, a main throttle downstream of said chamber, a choke valve upstream of said chamber, an electric drive for operating said choke valve, means for sensing at least one operating parameter of said engine, and a control device which is controlled by said sensing means and controls said electric drive to move said choke valve into positions for cold starting, running-up and hot-running mixture enrichment, said method comprising the steps of holding said choke valve open in steady operation of said engine and temporarily abruptly at least partly closing said choke valve by means of said electric drive upon operation of said main throttle to accelerate said engine, measuring a plurality of operating parameters of said engine and making the magnitude and duration of said closing of said choke valve dependent upon the measurements of said parameters, said operating parameters include the magnitude of the opening of the said main throttle before acceleration starts, the speed of opening of said throttle during acceleration, engine temperature and engine speed and further comprising using control signals from said sensed parameters, feeding said control signals to an electronic controller and causing said electronic controller to control said electric drive so that the magnitude and duration of said closing of said choke valve are decreased in relation to the increase of said opening of said main throttle before acceleration, the decrease of the speed of opening of said main throttle, the increase of said engine temperature and the increase of said engine speed.

6. In apparatus for supplying combustible fuel mixture to an internal combustion engine, said apparatus providing transition enrichment required during acceleration of the engine comprising a combustible mixture generator, said mixture generator including means defining a mixing chamber having an upstream and a downstream end, a main throttle located at the downstream end of said chamber, a choke valve located at the upstream end of said chamber, an electric drive connected to said choke valve for opening and closing said choke valve, a control device, means operatively connecting said control device to said electric drive, means for sensing at least one operating parameter of said engine, and means operatively connecting said sensing means to said control device whereby said control device causes said electric drive to move said choke valve into positions for cold starting, running-up and hot-running mixture enrichment in dependence upon said at least one parameter, the improvement wherein said electric drive includes a quick-acting rotary drive motor and means torsionally rigidly connecting said quick-acting drive motor to said choke valve, said choke valve normally maintained in the open position during engine operation, and further comprising means for sensing the opening of said main throttle above a predetermined threshold valve during acceleration operation, said throttle sensing means comprising a position sensor coupled to said main throttle valve for detecting the instantaneous degree of opening of said main throttle valve and for producing a signal, and means for communicating the signal from said sensor to said control device whereby said control device causes said electric drive to close said choke valve abruptly and temporarily by a predetermined amount when opening of said main throttle valve above the predetermined threshold value is sensed by said throttle sensing means.

7. Apparatus as claimed in claim 6, in which said main throttle comprises a flap and means pivotally mounting said flap.

8. Apparatus as claimed in claim 7, in which said angular-position sensor comprises a potentiometer, a movable tap on said potentiometer and means drivingly mechanically connecting said tap to said throttle.

9. Apparatus as claimed in claim 7, in which said angular-position sensor comprises an inductive angle indicator and means coupling said indicator to said main throttle.

10. Apparatus as claimed in claim 7, in which said angular-position sensor comprises an optical angle indicator and means coupling said indicator to said main throttle.

11. Apparatus as claimed in claim 6, in which said control device includes a circuit connected to said sensor for sensing the opening of said main throttle, said circuit differentiating with respect to time said opening of said main throttle and providing a signal indicating the rate of opening of said throttle.

12. Apparatus as claimed in claim 6, further comprising an engine speed sensor and at least one engine temperature sensor and means connecting said engine speed sensor and said at least one engine temperature sensor to an input of said control device, said engine speed and said engine temperature forming at least some of said operating parameters of said engine.

13. Apparatus as claimed in claim 12, in which said at least one engine temperature sensor is arranged to sense the temperature of a wall of an inlet manifold of said engine.

14. Apparatus as claimed in claim 13, in which said sensor for sensing the temperature of said wall is disposed in the vicinity of an engine cooling water passage of said engine.

15. Apparatus as claimed in claim 6, in which said control device is a microprocessor including a memory, said memory having performance data of said engine stored therein, and said microprocessor converting said at least one parameter into control signals for controlling said electric drive in dependence upon said parameters and said data.

16. Apparatus as claimed in claim 6, further comprising means defining an air flow path of said mixture generator and air-volume meter means in said air flow path, said meter means producing output signals dependent upon said air volume flowing in said air flow path and means for feeding said signals to said control device.

17. In apparatus for supplying combustible fuel mixture to an internal combustion engine, said apparatus comprising a combustible mixture generator, said mixture generator including means defining a mixing chamber, a main throttle downstream of said chamber, a choke valve upstream of said chamber, an electric drive for opening and closing said choke valve, a control device, means operatively connecting said control device to said electric drive, means for sensing at least one operating parameter of said engine, and means operatively connecting said sensing means to said control device whereby said control device causes said electric drive to move said choke valve into positions for cold starting, running-up and hot-running mixture enrichment in dependence upon said at least one parameter, the improvement wherein said electric drive includes quick-acting drive means and means torsionally rigidly connecting said quick-acting drive to said choke valve and further comprising means for sensing the opening of said main throttle, said sensing means producing a signal and means communicating said signal to said control device whereby said control device causes said electric drive to close said choke valve abruptly and temporarily when opening of said main throttle is sensed by said sensing means, said choke valve includes a choke valve flap and means pivotally mounting said choke valve flap and said electric drive comprises a two-coil rotary setter including a first winding, a second winding offset at an angle of 90° to said first winding, means for feeding direct currents independently to said first winding and said second winding, a permanent-magnet rotor controlled by said windings and means torsionally rigidly connecting said rotor to said choke valve flap.

* * * * *